US012013158B2

(12) United States Patent
Zhou et al.

(10) Patent No.: US 12,013,158 B2
(45) Date of Patent: Jun. 18, 2024

(54) RECEIVER, CONNECTION METHOD THEREOF, RECEIVER ASSEMBLY AND HEAT PUMP SYSTEM

(71) Applicant: Carrier Corporation, Palm Beach Gardens, FL (US)

(72) Inventors: Xingye Zhou, Shanghai (CN); Shuguang Zhang, Shanghai (CN); Guangyu Shen, Shanghai (CN); Xi Feng, Shanghai (CN); Jinxiang Wang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 159 days.

(21) Appl. No.: 17/573,986

(22) Filed: Jan. 12, 2022

(65) Prior Publication Data

US 2022/0228785 A1 Jul. 21, 2022

(30) Foreign Application Priority Data

Jan. 15, 2021 (CN) ..... 202110054086.6

(51) Int. Cl.
*F25B 43/00* (2006.01)
*F24D 15/04* (2006.01)
(Continued)

(52) U.S. Cl.
CPC ..... *F25B 43/006* (2013.01); *F24D 15/04* (2013.01); *F24H 4/02* (2013.01); *F24H 9/12* (2013.01); *F25B 13/00* (2013.01); *F25B 30/02* (2013.01); *F25B 41/20* (2021.01); *F24D 2220/02* (2013.01); *F24D 2220/0214* (2013.01); *F24D 2220/0228* (2013.01); *F24D 2220/025* (2013.01); *F24D 2220/0285* (2013.01); *F24F 2221/54* (2013.01); *F25B 2313/007* (2013.01); *F25B 2313/0233* (2013.01); *F25B 2400/16* (2013.01)

(58) Field of Classification Search
CPC ..... F25B 41/20; F25B 13/00; F25B 30/02; F25B 2313/007; F25B 2313/0233
See application file for complete search history.

(56) References Cited

U.S. PATENT DOCUMENTS 6,668,569 B1 * 12/2003 Jin ..... F25B 13/00 62/509
6,826,924 B2 * 12/2004 Shimoda ..... F25B 13/00 62/324.4
2014/0311179 A1 * 10/2014 Kojima ..... F25B 41/26 62/467

FOREIGN PATENT DOCUMENTS

CN 203489543 U 3/2014
CN 110243083 A 9/2019
EP 0783093 A2 7/1997

OTHER PUBLICATIONS

European Search Report for application EP 22151614.9, dated Jun. 28, 20222, 7 pages.

(Continued)

*Primary Examiner* — Henry T Crenshaw
(74) *Attorney, Agent, or Firm* — CANTOR COLBURN LLP

(57) ABSTRACT

A receiver, a receiver assembly and a heat pump system. The receiver includes a first pipe, a second pipe and a third pipe leading to the cavity of the receiver, wherein the first pipe, the second pipe and the third pipe connect to a first load unit, a second load unit and a cold and heat source unit, respectively.

8 Claims, 3 Drawing Sheets

(51) Int. Cl.

| | |
|---|---|
| ***F24H 4/02*** | (2022.01) |
| ***F24H 9/12*** | (2022.01) |
| ***F25B 13/00*** | (2006.01) |
| ***F25B 30/02*** | (2006.01) |
| ***F25B 41/20*** | (2021.01) |

(56) References Cited

OTHER PUBLICATIONS

European Search Report for application EP 22151614.9, dated Oct. 2, 2023, 5 pages.

* cited by examiner

RECEIVER, CONNECTION METHOD THEREOF, RECEIVER ASSEMBLY AND HEAT PUMP SYSTEM

FOREIGN PRIORITY

This application claims priority to Chinese Patent Application No. 202110054086.6, filed Jan. 15, 2021, and all the benefits accruing therefrom under 35 U.S.C. § 119, the contents of which in its entirety are herein incorporated by reference.

TECHNICAL FIELD

The present disclosure relates to the field of heat pump systems, in particular to a receiver structure for use with three units and a heat pump system having the same.

BACKGROUND

In a heat pump system, because the amount of refrigerant required in a refrigeration cycle and a heating cycle are different, a receiver is often provided. The receiver can store excess refrigerant during the heating cycle and release refrigerant in the refrigeration cycle for use by the system.

For a multi-function heat pump system, such as a heat pump system with three units, the conventional two-pipe receiver can only be connected between two units, so that in some modes, the receiver cannot function to store or release refrigerant. In addition, if the receiver which stores the refrigerant is not connected to a thermal cycle, the receiver will form a dead zone, and the refrigerant in it cannot be used for system operation.

SUMMARY OF THE INVENTION

The purpose of the present disclosure is to solve or at least alleviate the problems in the prior art.

According one aspect, a receiver is provided, which comprises: a first pipe, a second pipe and a third pipe leading to a cavity of the receiver, wherein the first pipe, the second pipe and the third pipe connect to a first load unit, a second load unit and a cold and heat source unit, respectively.

Optionally, the receiver is placed upright, and the first pipe, the second pipe and the third pipe enter the cavity of the receiver from the top of the receiver and extend to the bottom of the receiver; or the receiver is placed upside down, and the first pipe, the second pipe, and the third pipe enter the receiver from the bottom of the receiver.

According another aspect, a heat pump system is provided, which comprises: the receiver according to various embodiments; a first load unit connected to the first pipe of the receiver; a second load unit connected to the second pipe of the receiver; and a cold and heat source unit connected to the third pipe of the receiver.

Optionally, in the heat pump system, the first load unit and/or the second load unit are selected from an air conditioning unit, a hot water generating unit, a floor heating unit, and a refrigerator cabinet unit.

Optionally, in the heat pump system, the first load unit is a refrigerator cabinet unit, and the second load unit is an air conditioning unit.

Optionally, in the heat pump system, the cold and heat source unit comprises: a compressor, a switching device, a heat exchanger, and a throttling device. The receiver and the cold and heat source unit are integrated in a same outdoor unit housing, or arranged separately.

Optionally, in the heat pump system, the heat pump system can operate in one, multiple, or all of the following modes: a first mode in which the first load refrigerates and the second load shuts down; a second mode in which the first load heats and the second load shuts down; a third mode in which the first load shuts down and the second load refrigerates; a fourth mode in which the first load shuts down and the second load heats; a fifth mode in which the first load refrigerates and the second load refrigerates; a sixth mode in which the first load heats and the second load heats; a seventh mode in which the first load refrigerates and the second load heats; and an eighth mode in which the first load heats and the second load refrigerates; wherein, the receiver functions in any of the above modes.

According another aspect, a receiver assembly for use in a heat pump system is provided, which comprises: a receiver; a first pipe and a second pipe leading to the receiver; wherein, the receiver assembly further comprises: a third pipe connected between the first pipe and the second pipe, wherein a first check valve and a second check valve are provided on the third pipe, and the first check valve and the second check valve only allow fluid to flow from the first pipe to the second pipe.

Optionally, in the receiver assembly, the first pipe connects to a first load unit and the second pipe connects to a second load unit, and a connection point for a cold and heat source unit is provided between the first check valve and the second check valve on the third pipe.

According another aspect, a heat pump system is provided, which comprises the receiver assembly according to the embodiments.

Optionally, in the heat pump system, the first load unit and/or the second load unit are selected from an air conditioning unit, a hot water generating unit, a floor heating unit, and a refrigerator cabinet unit.

Optionally, in the heat pump system, the first load unit is a refrigerator cabinet unit, and the second load unit is an air conditioning unit.

Optionally, in the heat pump system, the cold and heat source unit comprises a compressor, a switching device such as a four-way valve, a heat exchanger, and a throttling device. The receiver and the cold and heat source unit are integrated in a same outdoor unit housing, or arranged separately.

Optionally, in the heat pump system, the receiver is placed upright, and the first pipe and the second pipe extend to the bottom of the receiver; or the receiver is placed upside down.

Optionally, in the heat pump system, the heat pump system can operate in one, multiple, or all of the following modes: a first mode in which the first load refrigerates and the second load shuts down; a third mode in which the first load shuts down and the second load refrigerates; a fourth mode in which the first load shuts down and the second load heats; a fifth mode in which the first load refrigerates and the second load refrigerates; a seventh mode in which the first load refrigerates and the second load heats; wherein, the receiver functions in any of the above modes.

Optionally, in the heat pump system, in the fifth mode, the refrigerant passes from the second load unit through the second pipe, the receiver and the first pipe, and flows to the first load unit.

According another aspect, a method for connecting a receiver is further provided, which comprises: connecting a first pipe and a second pipe of the receiver through a third pipe, wherein a first check valve and a second check valve are provided on the third pipe, and the first check valve and the second check valve only allow fluid to flow from the first pipe to the second pipe; and connecting the first pipe to a first load unit, connecting the second pipe to a second load unit, and connecting a cold and heat source unit between the first check valve and the second check valve on the third pipe.

The receiver structure according to the embodiments of the present invention can be applied to a heat pump system with three or more units, so that the receiver can function in more modes.

BRIEF DESCRIPTION OF THE DRAWINGS

With reference to the drawings, the disclosure of the present invention will become easier to understand. It is easy for those skilled in the art to understand that these drawings are only for illustrative purposes, and are not intended to limit the scope of protection of the present invention. In addition, similar numerals in the figures are used to denote similar components, among which.

DETAILED DESCRIPTION OF THE INVENTION

Figure 1:
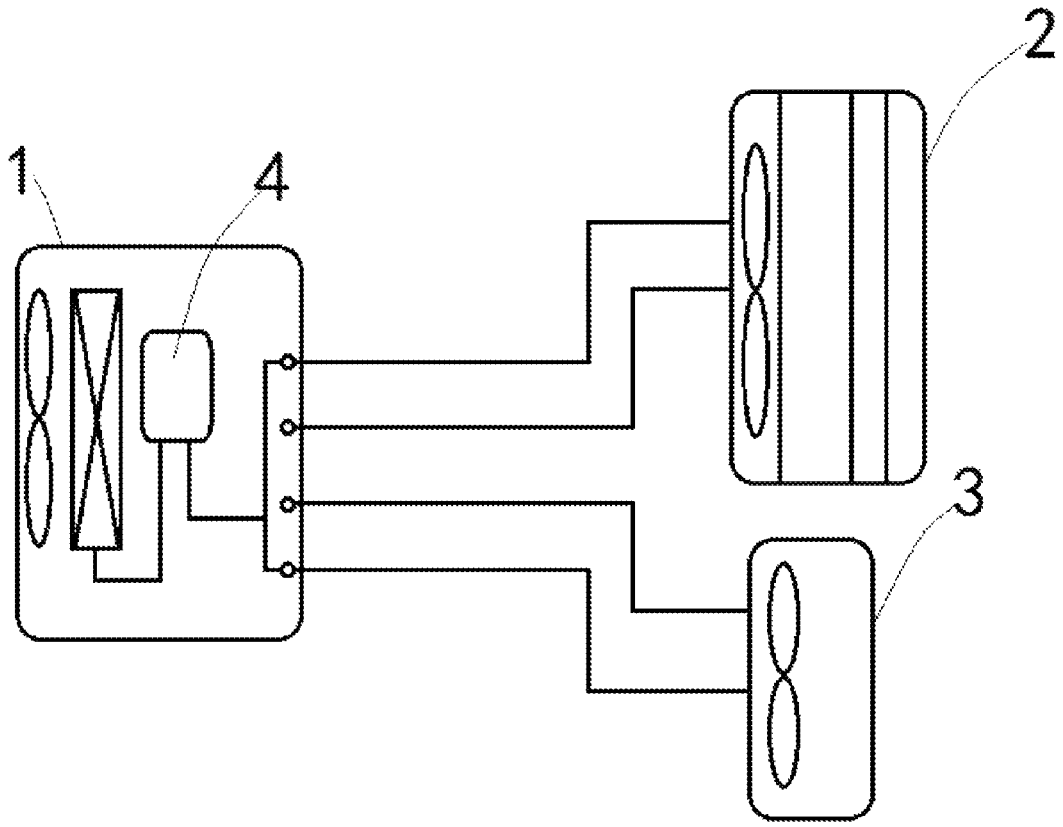
FIG. 1 shows a schematic structural diagram of a heat pump system using a conventional two-pipe receiver.

FIG. 1 shows a conventional arrangement of a receiver in a refrigeration system having three units. The refrigeration system comprises: a cold and heat source unit 1, a first load unit 2 and a second load unit 3. Generally, a receiver 4 can be, for example, arranged outdoors together with the cold and heat source unit 1, or can be arranged separately from the cold and heat source unit 1 (for example, arranged together with the first load unit 2 or the second load unit 3). When the refrigerant flows from the cold and heat source unit 1 to the first load unit 2 and/or the second load unit 3, it will pass through the receiver 4. The system can, for example, be operated in a heat recovery mode in which one of the first load unit 2 and the second load unit 3 refrigerates and the other heats. At this time, the refrigerant will directly flow from one of the first load unit 2 and the second load unit 3 to the other without passing through the receiver 4. At this time, the receiver 4 becomes a dead zone in the system. If a relatively large amount of refrigerant is stored in the receiver 4, it may cause a lack of refrigerant in the operating parts of the system, i.e., between the first load unit 2 and the second load unit 3.

Figure 2:
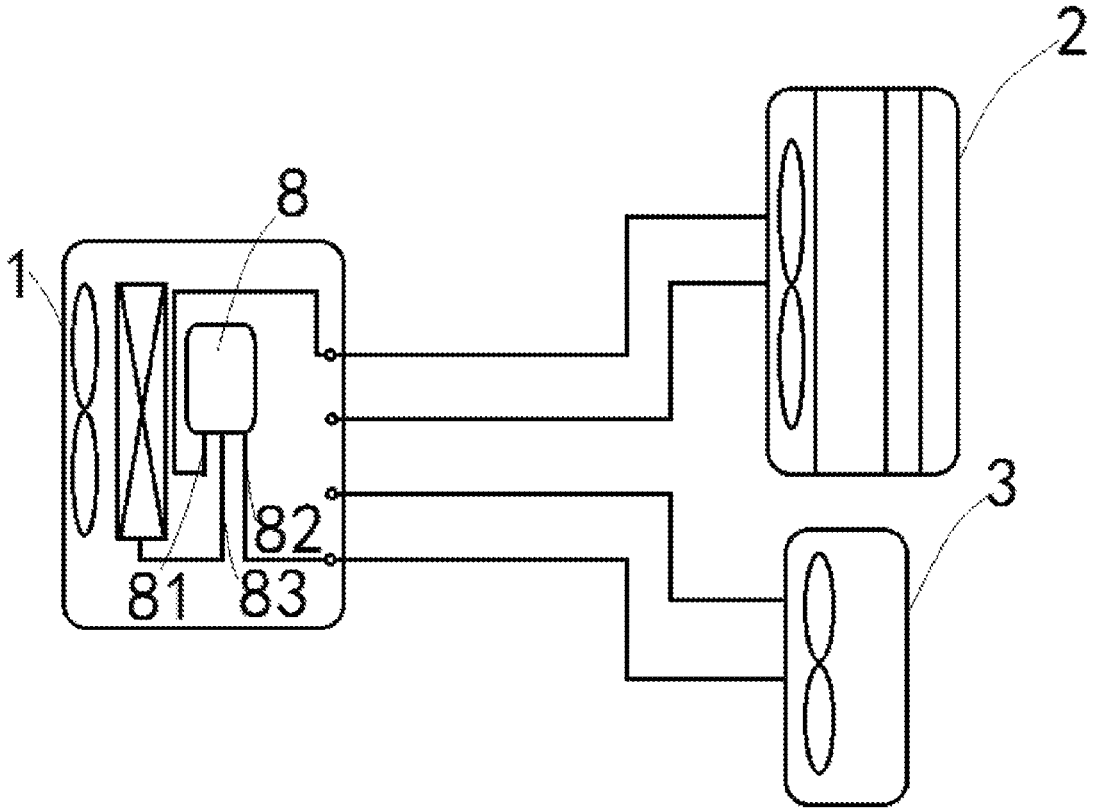
FIG. 2 shows a schematic structural diagram of a heat pump using the receiver structure according to an embodiment of the present invention.

With continued reference to FIG. 2, a receiver according to an embodiment of the present invention is shown. A receiver 8 comprises: a first pipe 81, a second pipe 82 and a third pipe 83 leading to the cavity of the receiver, wherein the first pipe 81, the second pipe 82 and the third pipe 83 connect to a first load unit 2, a second load unit 3 and a cold and heat source unit 1, respectively. By using the three-pipe receiver, in the case where any two or three of the first load unit 2, the second load unit 3, and the cold and heat source unit 1 are operating, the refrigerant will pass through the receiver 8, so the receiver 8 can function under various working conditions. In some embodiments, the receiver 8 may be placed upright, wherein the first pipe 81, the second pipe 82 and the third pipe 83 enter the cavity of the receiver from the top of the cavity of the receiver, and extend to the bottom of the cavity of the receiver. In other embodiments, as shown in FIG. 2, the receiver 8 can be placed upside down in the system, wherein the first pipe 81, the second pipe 82, and the third pipe 83 can enter the cavity of the receiver from the bottom of the cavity of the receiver.

The heat pump system configured with a three-pipe receiver 8 as shown in FIG. 2 further comprises: a first load unit 2 connected to the first pipe 81 of the receiver 8; a second load unit 3 connected to the second pipe 82 of the receiver; and a cold and heat source unit 1 connected to the third pipe 83 of the receiver.

In some embodiments, the first load unit 2 and/or the second load unit 3 are selected from an air conditioning unit, a hot water generating unit, a floor heating unit, and a refrigerator cabinet unit. In some embodiments, the first load unit 2 is a refrigerator cabinet unit, and the second load unit 3 is an air conditioning unit. In some embodiments, the cold and heat source unit 1 comprises: a compressor, a switching device (such as a four-way valve), a heat exchanger, and a throttling device (such as an expansion valve). In the embodiment shown in FIG. 2, the receiver 8 and the cold and heat source unit 1 are integrated in the same outdoor unit housing. In an alternative embodiment, the receiver 8 and the cold and heat source unit 1 can be arranged separately, for example, the receiver 8 can be integrated in the first load unit 2 or the second load unit 3.

The heat pump system configured with the receiver 8 can function in various operating modes. Specifically, in the case where the first load unit 2 refrigerates only, the refrigerant from the cold and heat source unit 1 enters the receiver 8 from the third pipe 83 and then flows to the first load unit 2 from the first pipe 81. In the case where the first load unit 2 heats only, the refrigerant flows through the receiver 8 in the direction opposite to that of the aforementioned refrigerating only mode. In the case where the second load unit 3 refrigerates only, the refrigerant from the cold and heat source unit 1 enters the receiver 8 from the third pipe 83 and then flows to the second load unit 3 from the second pipe 82. In the case where the second load unit 3 heats only, the refrigerant flows through the receiver 8 in the direction opposite to that of the aforementioned heating only mode. In the case where the first load unit 2 and the second load unit 3 refrigerate at the same time, the refrigerant from the cold and heat source unit 1 enters the receiver 8 from the third pipe 83 and divides into a first portion and a second portion, wherein the first portion of the refrigerant flows to the first load unit 2 through the first pipe 81, and the second portion of the refrigerant flows to the second load unit 3 through the second pipe 82. Similarly, in the case where the first load unit 2 and the second load unit 3 heat at the same time, the refrigerant flows in the direction opposite to that of the aforementioned mode in which both refrigerating at the same time. Finally, in the case where the first load unit 2 refrigerants and the second load unit 3 heats, the refrigerant enters the receiver 8 from the second load unit 3 through the second pipe 82, and flows to the first load unit 2 through the first pipe 81. In the case where the second load unit 3 refrigerants and the first load unit 2 heats, the refrigerant flows in the direction opposite to that of the aforementioned mode, and passes through the receiver 8. It should be appreciated that the receiver with three pipes 81, 82, 83 can function under various working conditions where the refrigerant flows between any two or three of the first load unit 2, the second load unit 3, and the cold and heat source unit 1.

Figure 3:
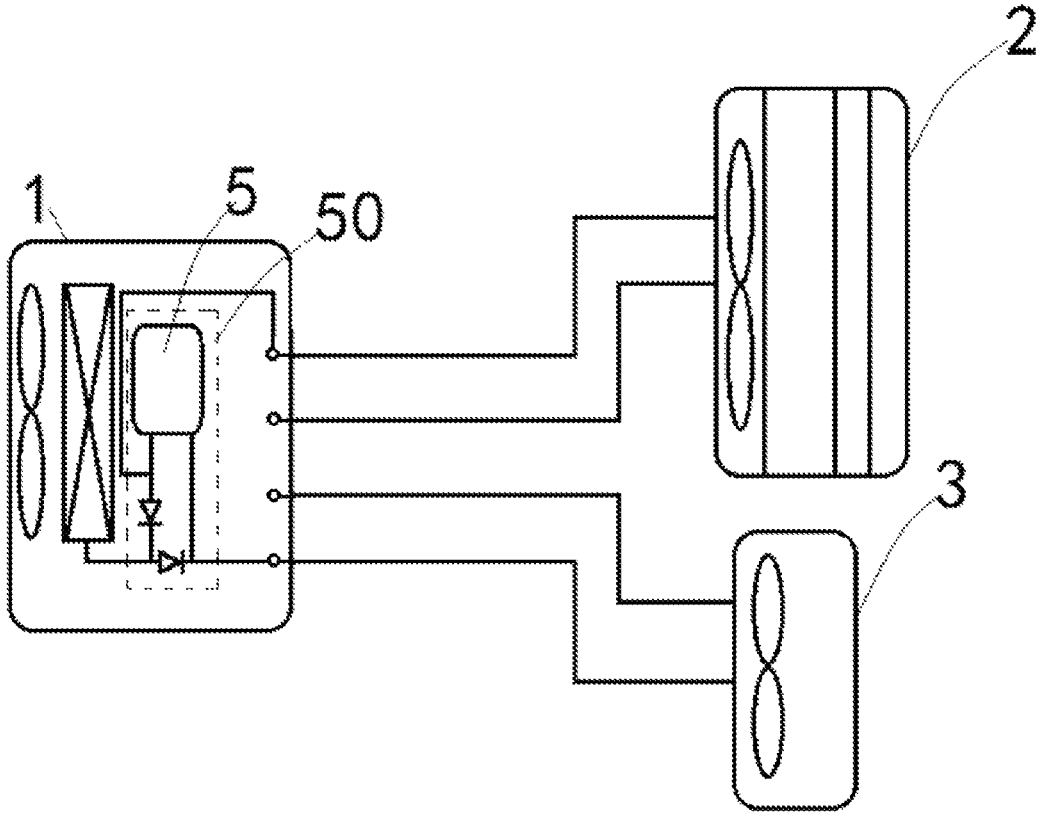
FIG. 3 shows a schematic structural diagram of a refrigeration system using the receiver structure according to another embodiment of the present invention.
Figure 4:
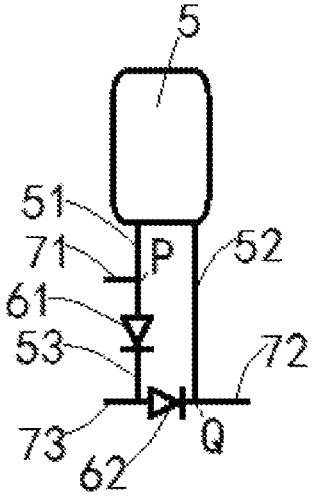
FIG. 4 shows an enlarged view of the parts of the receiver structure in FIG. 3.

The receiver assembly 50 according to an embodiment of the present invention is described in detail with continued reference to FIGS. 3 and 4. The receiver assembly 50 comprises a receiver 5, and several pipes and valves. In an embodiment, the receiver assembly 50 can be integrated with the cold and heat source unit 1 in an outdoor unit, for example, a common housing is provided to accommodate the cold and heat source unit 1. The cold and heat source unit 1 may be an outdoor unit, which may comprise components such as a compressor, a switching assembly (such as a four-way valve), a heat exchanger, a throttling device (such as an expansion valve), a gas-liquid separator, and so on.

As shown in detail in the enlarged view of FIG. 4, the receiver assembly comprises: a receiver comprising a first pipe 51 and a second pipe 52 leading to the receiver, and a third pipe 53 connected between the first pipe 51 and the second pipe 52. A first check valve 61 and a second check valve 62 are arranged in sequence on the third pipe 53. The first check valve 61 and the second check valve 62 are connected in series. The first check valve 61 and the second check valve 62 only allow fluid to flow from the first pipe 51 to the second pipe 52, more specifically, only allow fluid to flow from a connection point P of the third pipe 53 and the first pipe 51 to a connection point Q of the third pipe 53 and the second pipe 52. In some embodiments, the first pipe 51 is used to connect to a first load unit 2, for example, a first pipeline 71 is connected to the first pipe 51 and to the first load unit 2. Similarly, the second pipe 52 is used to connect to a second load unit 3, for example, a second pipeline 72 is connected to the second pipe 52 and to the second load unit 3. In some embodiments, the cold and heat source unit 1 is connected between the first check valve 61 and the second check valve 62 on the third pipe 53. More specifically, a third pipeline 73 is connected between the first check valve 61 and the second check valve 62 on the third pipe 53 and to the cold and heat source unit 1. The receiver assembly 50 according to the embodiments of the present invention realizes the application of the receiver in various modes among three units only through several pipes and check valves. For example, in the case where the first load unit 2 refrigerates only, the refrigerant from the cold and heat source unit 1 passes through the third pipeline 73, the second check valve 62, the second pipe 52, the receiver 5, the first pipe 51 and the first pipeline 71 in sequence, and then flows to the first load unit 2. In the case where the second load unit 3 refrigerates only, the refrigerant from the cold and heat source unit 1 passes through the third pipeline 73, the second check valve 62 and the second pipeline 72 in sequence, and then flows to the second load unit 3, and the receiver 5 connects to the second pipeline 72 through the second pipe 52, so the receiver 5 can store or release refrigerant through a separate second pipe 52. In the case where the second load unit 3 heats only, the refrigerant flows reversely from the second load unit 3 through the second pipeline 72, the second pipe 52, the receiver 5, the first pipe 51, the check valve 61 and the third pipeline 73 in sequence, and returns to the cold and heat source unit 1. In addition, in the case where the first load unit 2 and the second load unit 3 refrigerant at the same time, the refrigerant from the cold and heat source unit 1 passes through the third pipeline 73, and divides into a first portion and the second portion after passing through the second check valve 62, wherein the first portion of the refrigerant is delivered to the second load unit 3 through the second pipeline 72, and the second portion of the refrigerant passes through the second pipe 52, the receiver 5, the first pipe 51 and the first pipeline 71 in sequence, and flows to the first load unit 2. At this time, the receiver 5 is connected in the cycle and can store or release refrigerant. In the case where the first load unit 2 refrigerates and the second load unit 3 heats, the refrigerant flows from the second load unit 3 to the first load unit 2 to recover part of the heat, and the refrigerant flows from the second pipeline 72 through the second pipe 52, the receiver 5, the first pipe 51 and the first pipeline 71, and is then delivered to the first load unit 2. Therefore, it is appreciated that the receiver assembly 50 according to the embodiments of the present invention can function in any of the aforementioned five modes.

Although the above description is based on units with five operating modes, specifically, the operating modes comprise: a first mode in which the first load refrigerates and the second load shuts down; a third mode in which the first load shuts down and the second load refrigerates; a fourth mode in which the first load shuts down and the second load heats; a fifth mode in which the first load refrigerates and the second load refrigerates; and a seventh mode in which the first load refrigerates and the second load heats. However, according to the actual situations of the load units, the refrigeration system may only operate in some of the above five modes, or the refrigeration system may also operate in other modes, for example, in the case where the first load unit heats only, and so on. These do not affect the functions of the receiver assembly 50.

In some embodiments, as shown in the figure, the receiver 5 may preferably be placed upside down. At this time, the gravity of the refrigerant can be used to assist the release of the refrigerant in the receiver, and the first pipe 51 and the second pipe 52 are disposed at the bottom of the receiver, and do not/cannot extend to the top of the receiver. In other embodiments, the receiver in the refrigeration system may be placed upright. At this time, the first pipe 51 and the second pipe 52 need to extend to the bottom of the receiver 5.

In some embodiments, the first load unit 2 and/or the second load unit 3 may be selected from any one of an air conditioning unit, a hot water generating unit, a floor heating unit, and a refrigerator cabinet unit. In some embodiments, the first load unit 2 may be a refrigerator cabinet unit. Since the refrigerator cabinet unit generally only operates in the refrigeration mode, and is in a state of multiple units connected in parallel and being turned on and off at irregular intervals, based on this characteristic, the refrigerator cabinet unit is connected to the first pipeline 71, so that the receiver 5 can provide sufficient refrigerant to ensure the refrigeration demand of the refrigerator no matter when the refrigerator cabinet unit has a refrigeration demand. In some embodiments, the second load unit 3 may be an air conditioning unit. Connecting the air conditioning unit to the second pipeline 72 allows the receiver 5 to possess the function of adjusting the circulation amount of the refrigerant in the system.

In addition, a method for connecting a receiver is further provided, which comprises: connecting a first pipe and a second pipe of the receiver through a third pipe, wherein a first check valve and a second check valve are provided on the third pipe, and the first check valve and the second check valve only allow fluid to flow from the first pipe to the second pipe; connecting the first pipe to a first load unit, connecting the second pipe to a second load unit, and connecting a cold and heat source unit between the first check valve and the second check valve on the third pipe.

The devices and method according to the embodiments of the present invention realize the application of the receiver in various modes only through the design of the receiver itself or the design of the connecting flow paths of the receiver and several check valves, in which no complicated control logic is involved, and a good stability is presented. In addition, the products according to the embodiments of the present invention can be easily implemented without adding excessive costs, and can also be used for simple transformation of existing systems.

The specific embodiments described above are only used to describe the principle of the present invention more clearly, wherein each component is clearly shown or described to make the principle of the present invention easier to understand. Without departing from the scope of the present invention, those skilled in the art can easily make various modifications or changes to the present invention. Therefore, it should be understood that these modifications or changes should be included in the scope of patent protection of the invention.

What is claimed is:

1. A receiver assembly for use in a refrigeration system, comprising:

a receiver;

a first pipe and a second pipe leading to a cavity of the receiver;

wherein, the receiver assembly further comprises:

a third pipe;

a first check valve connected between the first pipe and the third pipe;

a third pipeline connected to the third pipe;

a second pipeline connected to the second pipe;

a second check valve between the third pipeline and the second pipeline;

the first check valve and the second check valve allow fluid to flow from the first pipe to the second pipe;

wherein the first pipe connects to a first load unit, the second pipe connects to a second load unit, and a connection point for a cold and heat source unit is provided between the first check valve and the second check valve.

2. A heat pump system, comprising the receiver assembly according to claim 1.

3. The heat pump system according to claim 2, wherein the first load unit and/or the second load unit are selected from an air conditioning unit, a hot water generating unit, a floor heating unit, and a refrigerator cabinet unit.

4. The heat pump system according to claim 2, wherein the first load unit is a refrigerator cabinet unit, and the second load unit is an air conditioning unit.

5. A heat pump system comprising:

a receiver including:

a first pipe and a second pipe leading to a cavity of the receiver;

a third pipe:

a first check valve connected between the first pipe and the third pipe:

a third pipeline connected to the third pipe:

a second pipeline connected to the second pipe:

a second check valve between the third pipeline and the second pipeline:

the first check valve and the second check valve allow fluid to flow from the first pipe to the second pipe:

wherein a cold and heat source unit comprises: a compressor, a switching device, a heat exchanger and a throttling device, and the receiver and the cold and heat source unit are integrated in a same outdoor unit housing, or arranged separately.

6. A heat pump system comprising:

a receiver including:

a first pipe and a second pipe leading to a cavity of the receiver;

a third pipe;

a first check valve connected between the first pipe and the third pipe;

a third pipeline connected to the third pipe;

a second pipeline connected to the second pipe;

a second check valve between the third pipeline and the second pipeline;

the first check valve and the second check valve allow fluid to flow from the first pipe to the second pipe;

wherein the receiver is placed upright, and the first pipe and the second pipe extend to the bottom of the receiver.

7. The heat pump system according to claim 2, wherein the heat pump system is capable of operating in one, multiple, or all of the following modes:

a first mode in which the first load refrigerates and the second load shuts down;

a third mode in which the first load shuts down and the second load refrigerates;

a fourth mode in which the first load shuts down and the second load heats;

a fifth mode in which the first load refrigerates and the second load refrigerates;

a seventh mode in which the first load refrigerates and the second load heats;

wherein, the receiver functions in any of the above modes.

8. The heat pump system according to claim 7, wherein in the fifth mode, refrigerant passes from the second load unit through the second pipe, the receiver and the first pipe, and flows to the first load unit.

* * * * *